US011859452B2

(12) United States Patent
Bishop et al.

(10) Patent No.: US 11,859,452 B2
(45) Date of Patent: Jan. 2, 2024

(54) WET CONNECT SYSTEM AND METHOD

(71) Applicants: David Bishop, Cypress, TX (US); Ronald J. Garr, Inola, OK (US)

(72) Inventors: David Bishop, Cypress, TX (US); Ronald J. Garr, Inola, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/716,643

(22) Filed: Apr. 8, 2022

(65) Prior Publication Data

US 2023/0323737 A1 Oct. 12, 2023

(51) Int. Cl.
*E21B 17/02* (2006.01)
*E21B 19/16* (2006.01)

(52) U.S. Cl.
CPC ..... *E21B 17/021* (2013.01); *E21B 19/16* (2013.01)

(58) Field of Classification Search
CPC ..... E21B 17/021; E21B 17/028
See application file for complete search history.

(56) References Cited

U.S. PATENT DOCUMENTS 4,799,546 A * 1/1989 Hensley ..... E21B 23/14 175/50
6,098,710 A 8/2000 Rhein-Knudsen et al.
6,520,257 B2 2/2003 Allamon et al.
(Continued)

FOREIGN PATENT DOCUMENTS

WO 2004044379 A2 5/2004
WO 2010128291 A2 11/2010
WO 2015092310 A1 6/2015

OTHER PUBLICATIONS

Notification of Transmittal of the International Search Report and the Written Opinion of the International Searching Authority, or the Declaration; PCT/US2023/017289; dated Jul. 12, 2023; 10 pages.
(Continued)

*Primary Examiner* — Shane Bomar
(74) *Attorney, Agent, or Firm* — CANTOR COLBURN LLP

(57) ABSTRACT

A latch system including a plurality of rocker latches, a rocker support, supporting the plurality of rocker latches, and a movement restrictor in operative connection with each rocker latch of the plurality of rocker latches, the movement restrictor allowing or restricting movement of each rocker latch of the plurality of rocker latches relative to the rocker support. A downhole tool including a sleeve movable relative to other portions of the tool, the sleeve having a profile at an uphole end thereof, an actuator runnable into contact with the sleeve, the actuator including the latch. A borehole system including a borehole in a subsurface formation, a string in the borehole, and a latch system disposed within or as a part of the string. A wet connect system including a first connector housing having a first communication line therein, a second connector housing concentrically positionable in the first connector housing and having a second communication line, and a balance piston fluidly connected to the first communication line.

15 Claims, 11 Drawing Sheets

(56) References Cited

U.S. PATENT DOCUMENTS

| | | | | |
|---|---|---|---|---|
| 6,755,253 | B2 * | 6/2004 | Smith | E21B 33/038 166/338 |
| 9,027,651 | B2 | 5/2015 | Frisby et al. | |
| 9,028,264 | B2 * | 5/2015 | Head | H01R 13/523 439/190 |
| 9,051,811 | B2 | 6/2015 | Bussear | |
| 10,502,040 | B1 | 12/2019 | Murugsan et al. | |
| 2003/0173077 | A1 * | 9/2003 | Smith | E21B 33/038 166/242.6 |
| 2003/0211768 | A1 | 11/2003 | Cameron et al. | |
| 2005/0095156 | A1 | 5/2005 | Wolters et al. | |
| 2006/0144588 | A1 | 7/2006 | Ferguson et al. | |
| 2008/0029274 | A1 | 2/2008 | Rytlewski et al. | |
| 2008/0302527 | A1 * | 12/2008 | Coronado | E21B 23/04 166/321 |
| 2010/0206561 | A1 | 8/2010 | Richards | |
| 2011/0306227 | A1 | 12/2011 | Pearce et al. | |
| 2013/0075109 | A1 | 3/2013 | Frisby et al. | |
| 2013/0126158 | A1 | 5/2013 | Gupta et al. | |
| 2014/0030904 | A1 * | 1/2014 | Head | H01R 13/523 439/283 |
| 2014/0124196 | A1 | 5/2014 | Sunde et al. | |
| 2015/0001385 | A1 | 1/2015 | Perriat et al. | |
| 2015/0105302 | A1 | 4/2015 | Pursley et al. | |
| 2016/0097750 | A1 | 4/2016 | Van Herzen et al. | |
| 2016/0340569 | A1 | 11/2016 | Belcher et al. | |
| 2016/0363693 | A1 | 12/2016 | Murugesan et al. | |
| 2017/0002629 | A1 | 1/2017 | Hurtevent et al. | |
| 2017/0022804 | A1 | 1/2017 | Gupta et al. | |
| 2020/0131894 | A1 | 4/2020 | Murugesan et al. | |
| 2021/0140247 | A1 * | 5/2021 | Bishop | E21B 17/028 |
| 2022/0003092 | A1 | 1/2022 | Murugesan et al. | |
| 2023/0279771 | A1 | 9/2023 | Murugesan et al. | |
| 2023/0323753 | A1 | 10/2023 | Bishop et al. | |

OTHER PUBLICATIONS

Fuzion Suite Downhole Wet-Mate Connectors; Halliburton; halliburton.com; Feb. 21, 2021.

HLWM Hydraulic-line downhole wet-mate connector; Schlumberger; slb.com/completions; 2017.

Murugesan et al., "Upconversion Nanoparticles as Tracers for Production and Well Monitoring"; Society of Petroleum Engineers SPE-191659-MS; Sep. 24, 2018; 10 pages.

Murugesan, et al., "Unconventional Nanotechnology-Based Tracers for Drilling and Completion Applications"; International Petroleum Technology Conference; Jan. 13, 2020; 15 pages.

Notification of Transmittal of the International Search Report and the Written Opinion of the International Searching Authority, or the Declaration; PCT/US2023/017294; dated Jul. 25, 2023: 12 pages.

* cited by examiner

WET CONNECT SYSTEM AND METHOD

BACKGROUND

In the resource recovery industry and fluid sequestration industries, Wet connect systems can greatly improve functionality by allowing connection and disconnection of hydraulic lines in the downhole environment. Difficulties include debris collecting at a connection location that may interfere with fluid movement or pressure conveyance, and physical limitations regarding running of the wet connect system. The art will appreciate alternative ways and means for wet connect systems.

SUMMARY

An embodiment of a latch system including a plurality of rocker latches, a rocker support, supporting the plurality of rocker latches, and a movement restrictor in operative connection with each rocker latch of the plurality of rocker latches, the movement restrictor allowing or restricting movement of each rocker latch of the plurality of rocker latches relative to the rocker support.

An embodiment of a downhole tool including a sleeve movable relative to other portions of the tool, the sleeve having a profile at an uphole end thereof, an actuator runnable into contact with the sleeve, the actuator including the latch system.

An embodiment of a borehole system including a borehole in a subsurface formation, a string in the borehole, and a latch system disposed within or as a part of the string.

An embodiment of a wet connect system including a first connector housing having a first communication line therein, a second connector housing concentrically positionable in the first connector housing and having a second communication line, and a balance piston fluidly connected to the first communication line.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
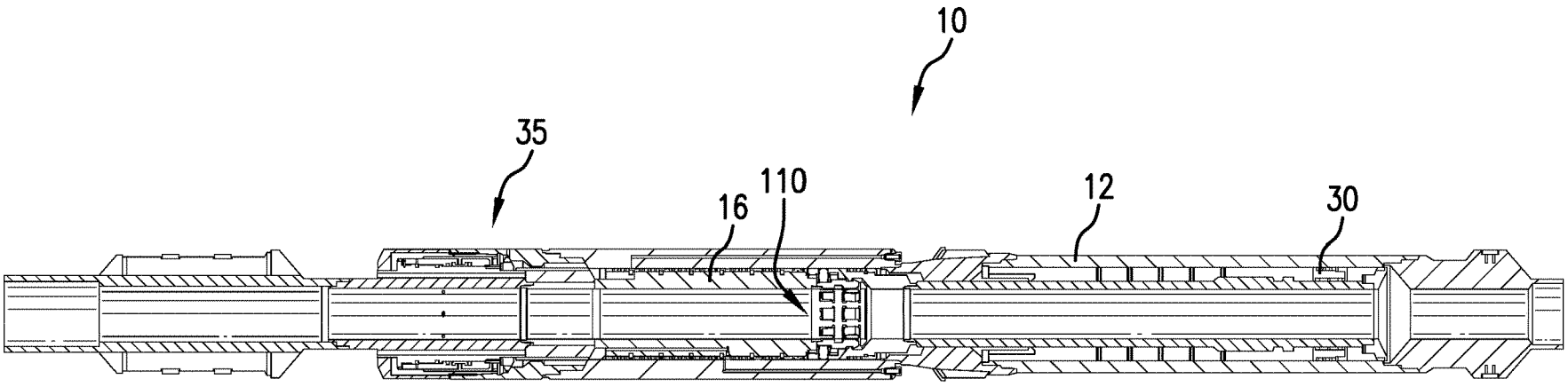
FIG. 1 is a cross sectional view of a wet connect system as disclosed herein.
Figure 2:
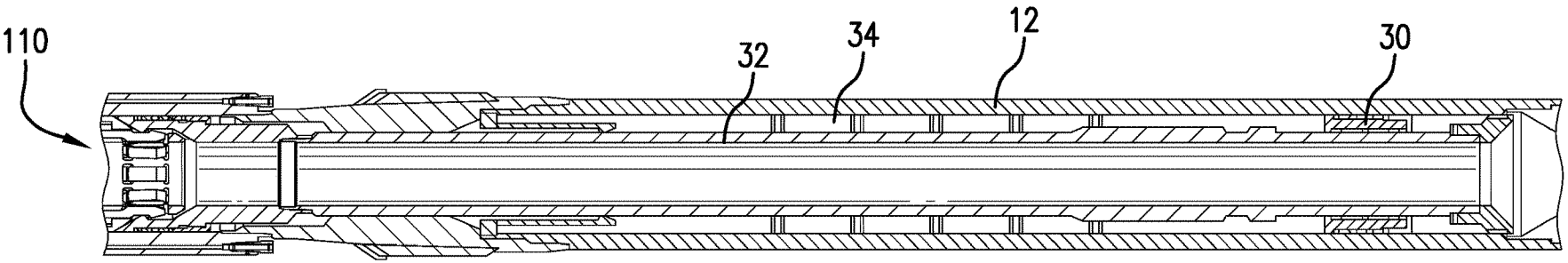
FIG. 2 is a cross sectional view of a portion of FIG. 1 illustrating a balance piston thereof in a sleeve open position.
Figure 3:
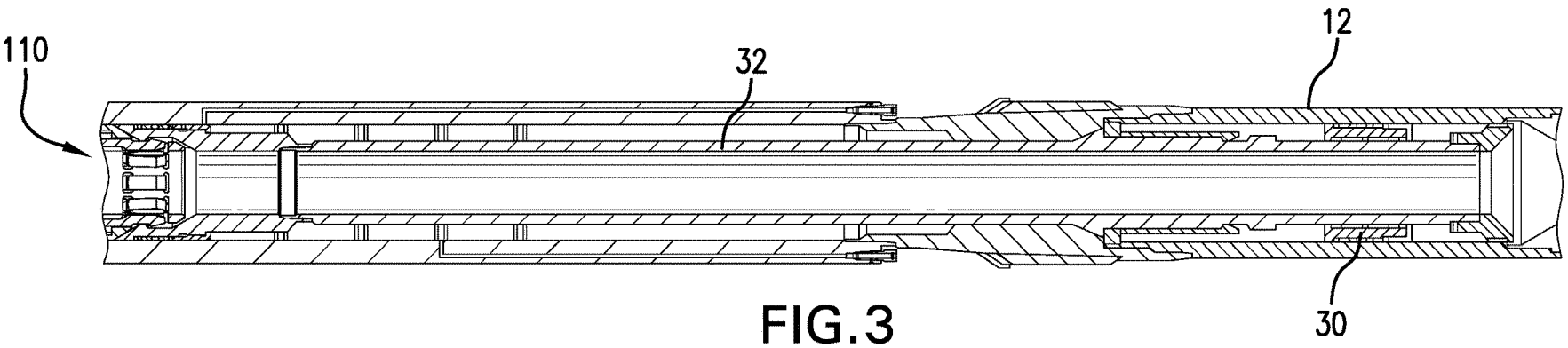
FIG. 3 is a cross sectional view of a portion of FIG. 1 illustrating a balance piston thereof in a sleeve closed position.

Referring to FIG. 1, a wet connect system 10 is illustrated. The system 10 comprises a first connector housing 12 having a first communication line 14 (see FIG. 10) therein. Line 14 is disposed within a wall of the housing 12 extending therealong for some distance. A second connector housing 16 is concentrically positionable within the first connector housing 12. Second connector housing 16 includes a second communication line 18 (see FIG. 5) within a wall thereof. The first and second connector housings 12 and 16 are positionable such that a port 156 of first communication line 14 and a counter port 158 of second communication line 18 may be communicated to one another through a manifold area 24 defined radially by the first housing 12 and the second housing 16 and axially by seals 160 and 162 Further, a balance piston 30 is disposed in the first housing 12 and functions to ensure pressure of a clean hydraulic fluid remains essentially the same (e.g., hydrostatic pressure) as a pressure of fluid in the first communication line 14 so that debris does not get into the first communication line 14 during portions of operation when the manifold area 24 is not sealed. The balance piston 30 is sealed to the first housing 12 and to a sleeve 32 within the housing 12. Referring to FIGS. 2 and 3, the sleeve 32 is movable within the housing and spaced therefrom to produce an annular space 34 between the sleeve 32 and the housing 12. It is in this space that the piston 30 may move in order to ensure that fluid disposed in the annular space between the balance piston 30 and the first communication line 14 (see FIG. 10) remains at hydrostatic pressure such that no debris is forced into line 14. The position of the balance piston 30 is illustrated with the sleeve 32 in the open position in FIG. 2 and the closed position in FIG. 3.

Figure 4:
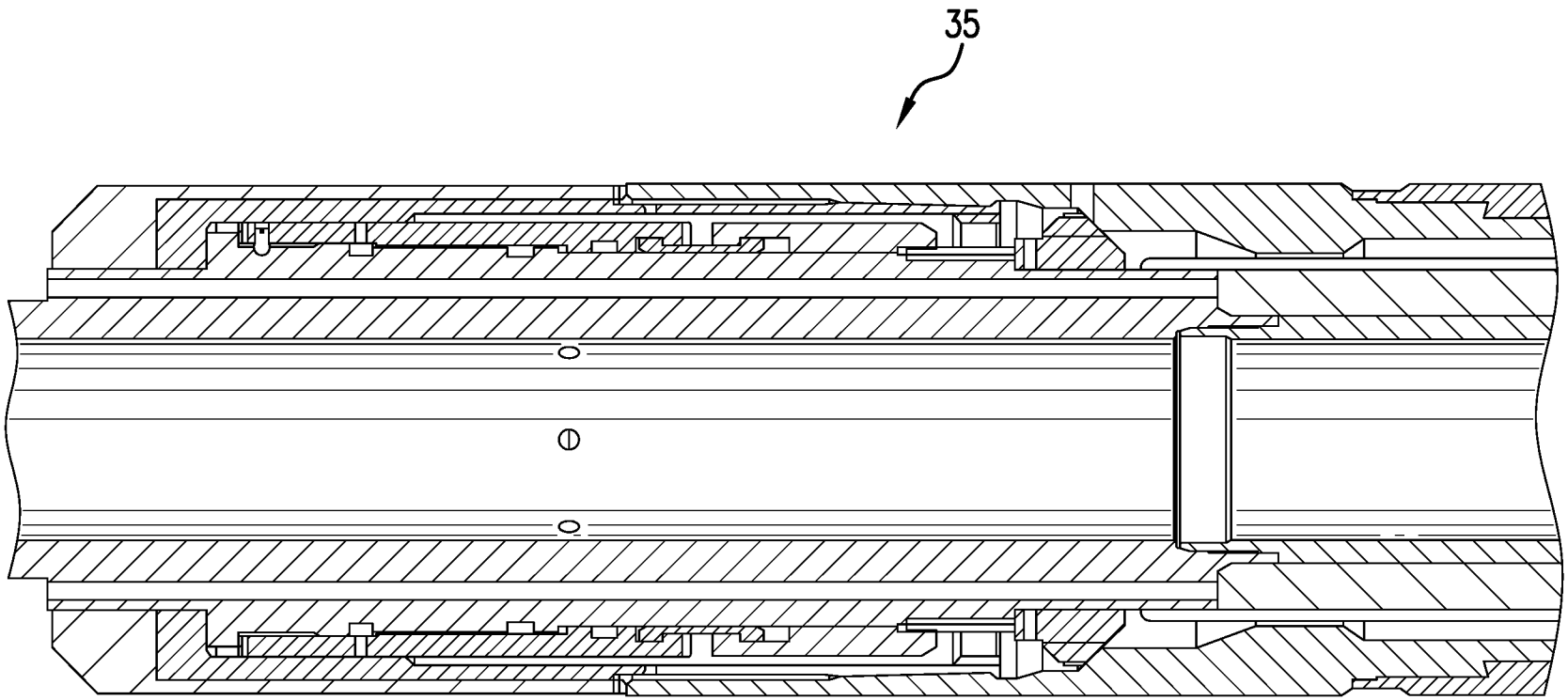
FIG. 4 is a cross sectional view of a portion of FIG. 1 illustrating a latch thereof.

Referring to FIGS. 1 and 4, the system 10 also includes a running latch 35. The running latch 35 is commercially available as a part of Baker Hughes' SureConnect™ connection movement restriction device, that is ordinarily used for running in the borehole, hence the name running latch used herein. Latches such as this have not however ben employed heretofore in connection with a set connect system such as system 10 since there has been no need to cause the systems of the prior art to carry weight until specifically released. The capability employed here is important to facilitate A one trip system where the weight of the lower completion must be supported. The running latch 35 maintains a load carrying configuration until it is hydraulically released.

Figure 5:
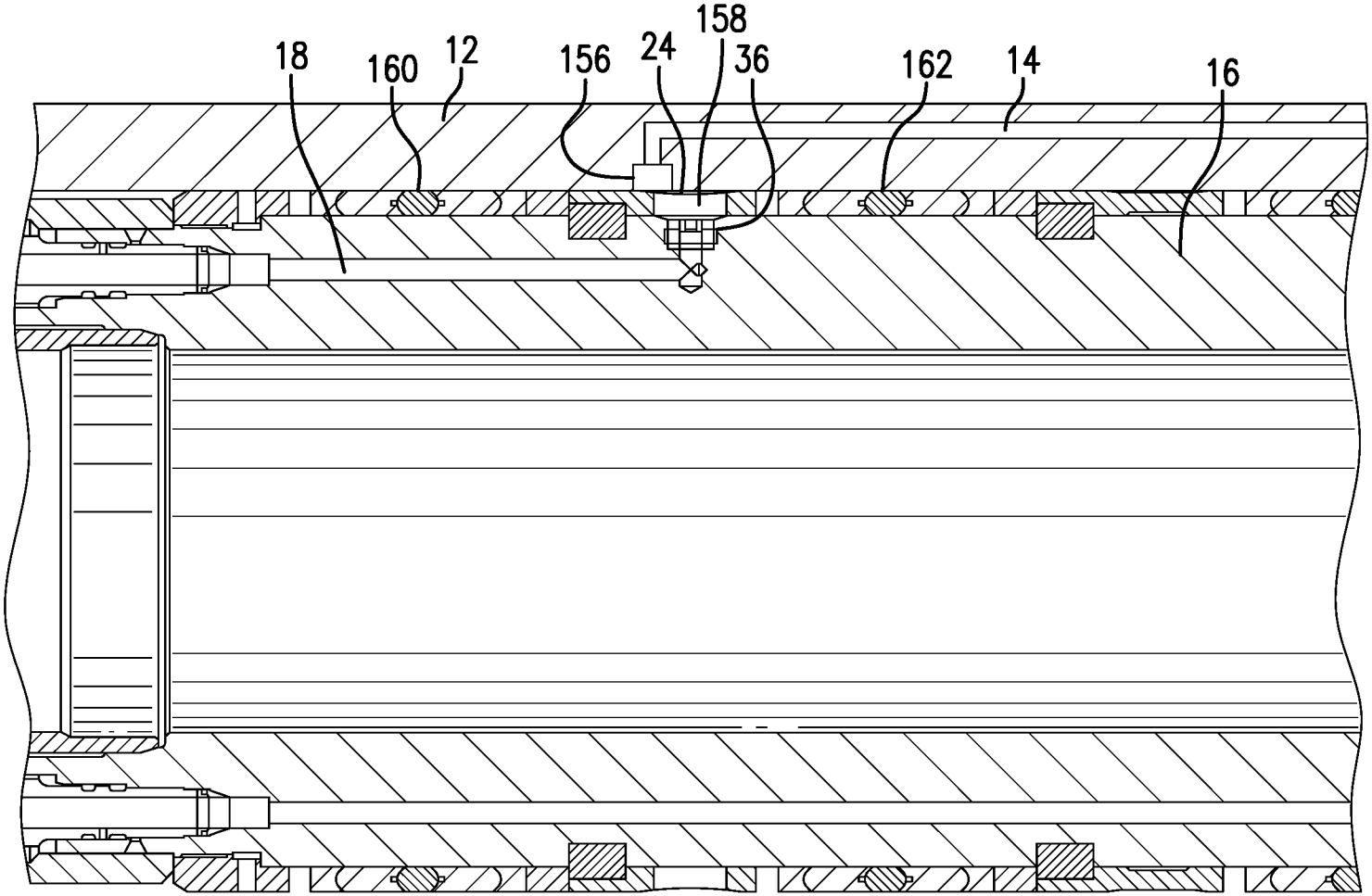
FIG. 5 is a cross sectional view of the system illustrating a burst disk in the hydraulic line.

Referring to FIG. 5, there is illustrated in the second communication line 18 an optional rupture disk 36 that may be employed to ensure the fluid within communication line 18 be clean at least until the disk 36 is ruptured.

Figure 6:
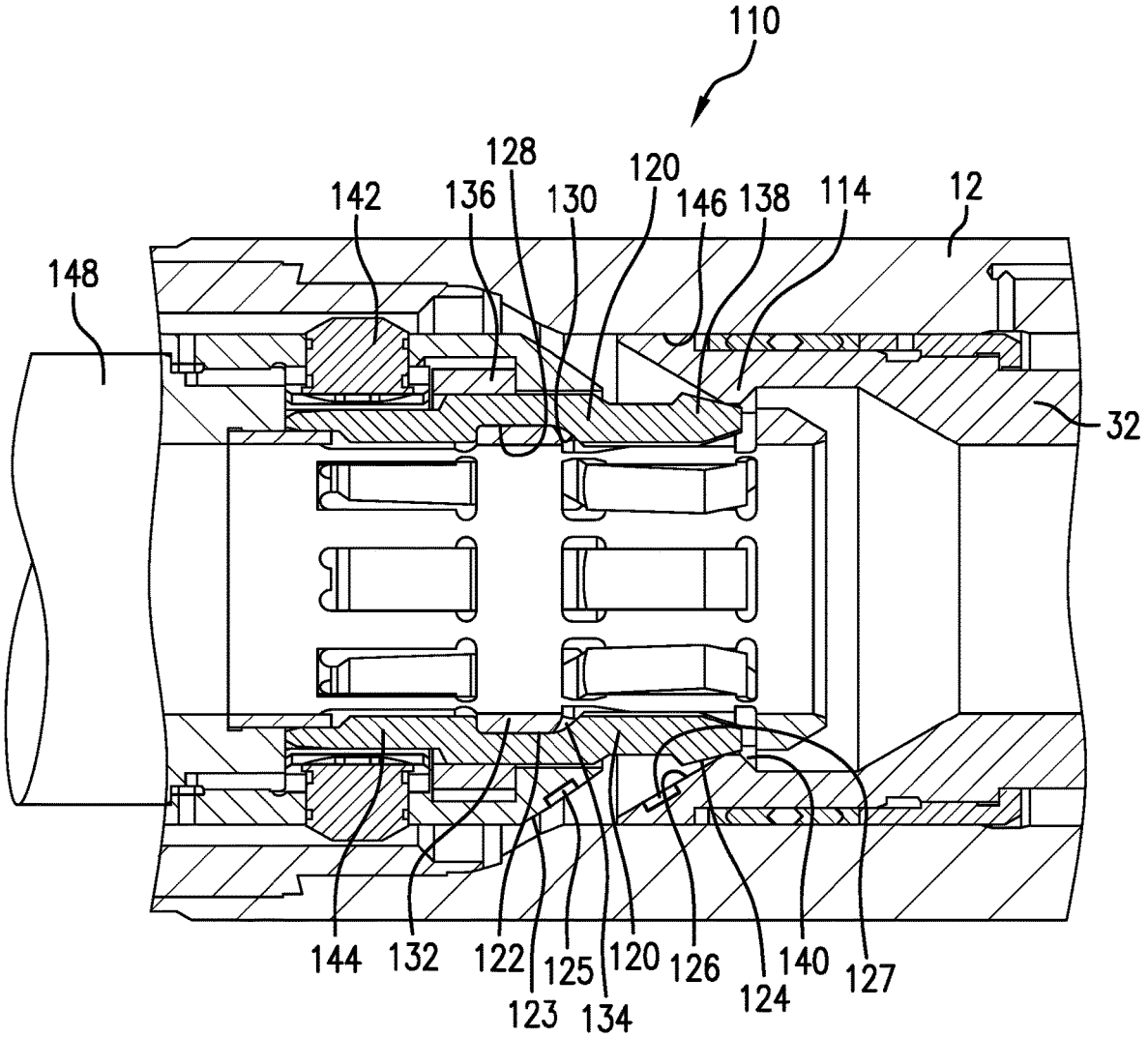
FIG. 6 is a cross section view of a latch system as disclosed herein in an unlatched unactuated position.

Referring to FIG. 6, an open/close latch system 110, that is usable with system 10 or otherwise, is illustrated. System 110 is configured to engage and latch the sleeve 32 that includes a profile 114 in order to move that sleeve 32 from an unactuated position to an actuated position and back to an unactuated position. As disclosed herein, the system 110 is configured to take this action with only a straight push and straight pull action, thus simplifying the process while also being reliable. The system 110 comprises a plurality of rocker latches 120 that are distributed about a rocker support 122. The number of rocker latches 120 could be one but one would introduce side loads that would be less desirable and accordingly the system 110 uses a plurality of rocker latches in even or odd number. Each of the rocker latches 120 include an insertion face 124 having an angle that helps the rocker latches 120 deflect radially inwardly when contacting a reception face 126 of the profile 114. After the insertion face 124 passes the reception face 126, a seal face 123 comes into contact with the reception face 126. In embodiments, seal face 123 and reception face 126 have differing angles from each other relative to a reference such as a longitudinal axis of the system 10. The difference in angle helps to create a seal between the faces as the system 10 is manipulated. Further, in embodiments, it is contemplated to add a seal material to face 123, face 126 or both. The seal material may be a softer material such as rubber, composite, or soft metal, for example, and serves the same purpose to enhance a seal between the faces during manipulation of the system 10. For clarity, the optional seal material is illustrated with numerals 125 (at face 123) and 127 (at face 126) in FIG. 6. Each rocker latch also has in an embodiment, a rocker recess 128 having a geometry that contributes to ease of radially inward deflection of the rocker latches 120. In an embodiment, the recess has a curved geometry 130 at one end interacting with a rocker pivot 132 of the support 122. It will be appreciated that the rocker pivot 132 may include a curved end 134 that interacts with the curved geometry 130 when the rocker latch 120 is deflected radially inwardly. Urging the insertion face 124 of the rocker latches 120 in the radially outward direction is a resilient retainer 136 that may in some embodiments comprise a snap ring or similar. The retainer 136 will help the rocker latches 120 engage a catch 138 of the latches 120 with a hold face 140 of profile 114. In order to prevent disengagement of the catch 138 and hold face 140 at an inappropriate time, a movement restrictor 142, which may be a dog in some embodiments, is positioned to interfere with a back end 144 of each latch 120. Specifically, when the dog reaches a seal bore 146 of the sleeve 32, the dog is pushed radially inwardly and not permitted to move radially outwardly while resident in the seal bore 146. While dog 142 cannot move radially outwardly, the rocker latches 120 cannot rock about the rocker pivot 132 to allow the insertion face 124 to move radially inwardly. Accordingly, while the system 110 including the dog 142 is in the seal bore 146, the latches 120 remain engaged and locked with the profile 114. Movement of a string 148 upon which the system 10 is mounted will thus move the sleeve 32 with a simple push or pull movement of the string.

Figure 7:
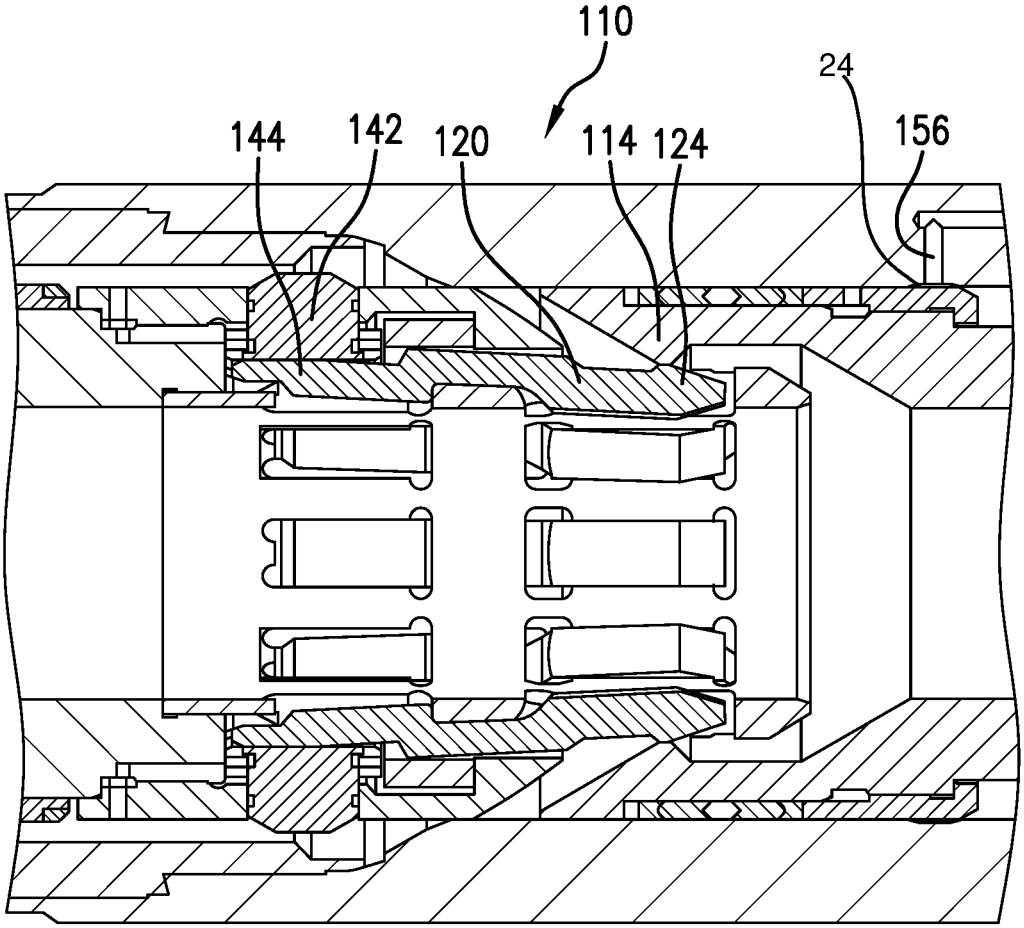
FIG. 7 is a view of the system of FIG. 6 during a latching engagement.
Figure 8:
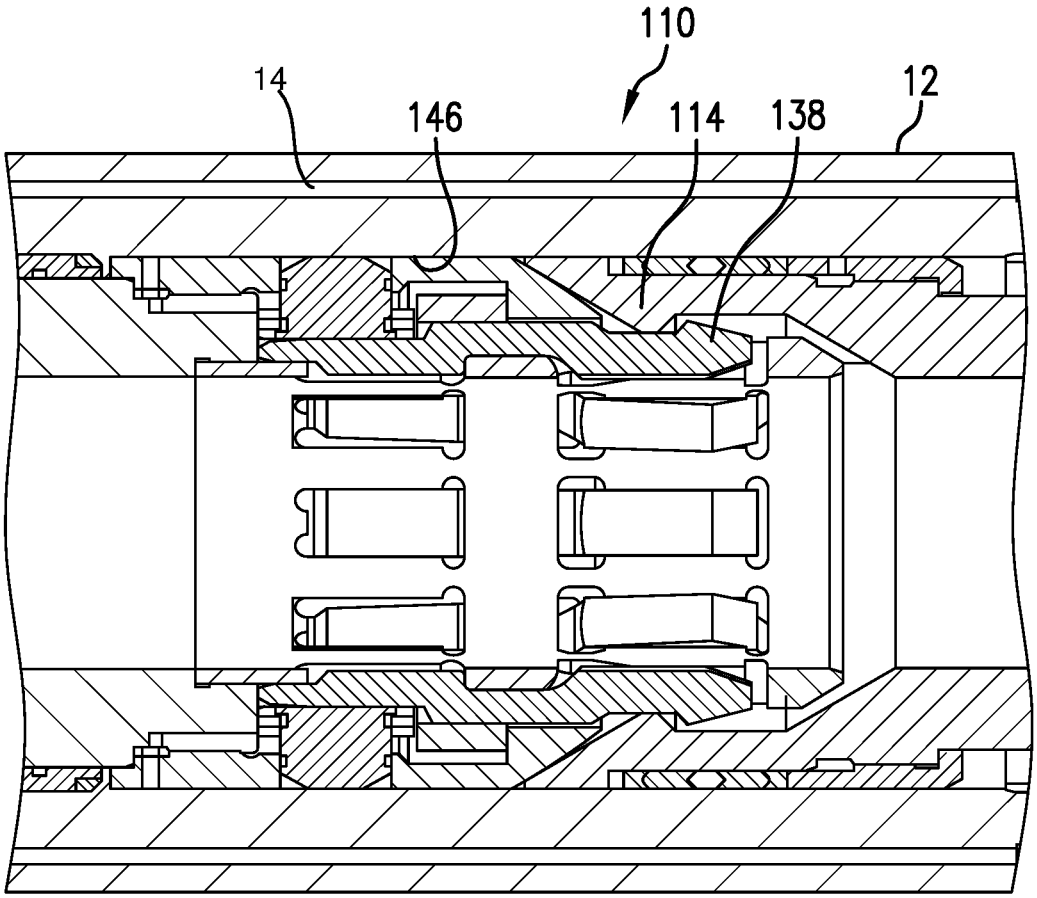
FIG. 8 is a view of the same system fully latched.
Figure 9:
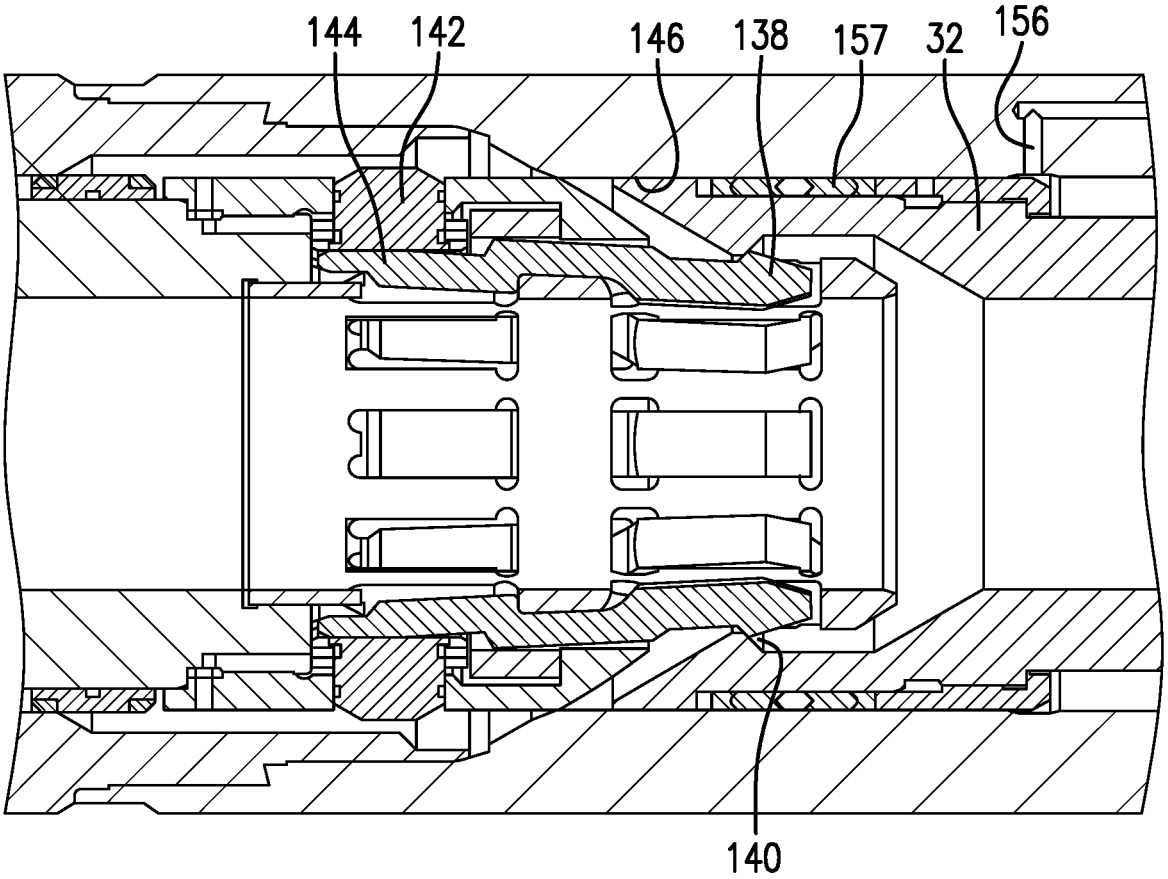
FIG. 9 is a view of the system partially unlatched during an unlatching operation.

With these components introduced reference is made to FIGS. 6-10 sequentially since they show the system 110 moving into and out of engagement with the sleeve 32 of wet connect system 10 FIG. 6 shows the system 110 having reached the profile 114 after being run in the hole. FIG. 7 illustrates what happens in the system 110 with continued downhole movement of the system 110 relative to the sleeve 32. It will be appreciated from FIG. 7 that the latches 120 are deflected inwardly so that the catch 138 of each latch 120, which includes the insertion face 124, can reposition to move past the reception face 126 and lockingly engage profile 114. Note that it is possible for the latches 120 to move in this way at this stage illustrated in FIG. 7 because the dogs 142 are not yet within the seal bore 146 and hence can be pushed radially outwardly by the back end 144 of latches 120. Moving to FIG. 8, such movement of the latches 120 is no longer possible since the dogs 142 are now in the seal bore 146 and cannot move radially outwardly. In this condition the system 110 is firmly connected to sleeve 32 and sleeve 32 will move either downhole or uphole based simply upon a push or a pull, respectively, on the string 148. The sleeve 32 may have many different actuation operations associated with it to operate many kinds of tools that need the sleeve to be repositioned. One specific example is a wet connect since the sleeve 32 may be employed to cover or uncover hydraulic ports 156 that are used to flush a connection area clean of debris and are to be protected when not in use. In the FIG. 9 view, the wet connect hydraulic ports 156 are closed. The sleeve 32 has been moved uphole by a pull on the string 148 and catch 138 interacting with hold face 140 transfers that pull to the sleeve 32. Also, to be appreciated in FIG. 9 is that dogs 142 are no longer in the seal bore 146 and accordingly can now move radially outwardly. With this mobility, rocker latches 120 back ends 144 may also move radially outwardly as a consequence of the catch 138 moving radially inwardly to clear the profile 114. This action is in progress in the FIG. 9 view, which also shows the ports 156 closed off by seal 157.

Figure 10:
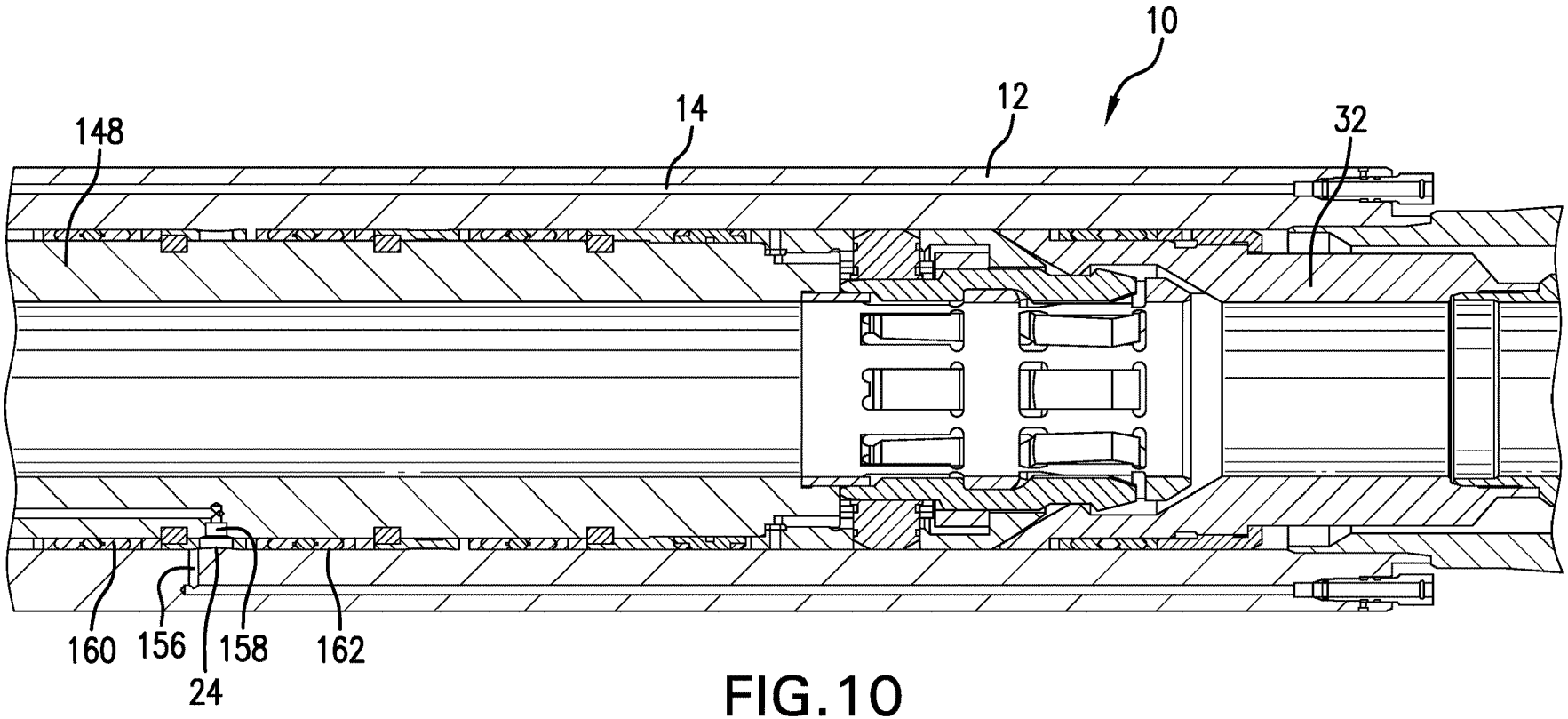
FIG. 10 is a view that shows more of a downhole tool with which the latch may be employed wherein hydraulic ports are illustrated open such that the downhole tool is in the actuated position.

Referring to FIG. 10, a particular embodiment where a wet connect is the tool 10 being actuated, the hydraulic ports 156 are seen open in FIG. 10 allowing fluid communication into counter ports 158 between seals 160 and 162.

Figure 11:
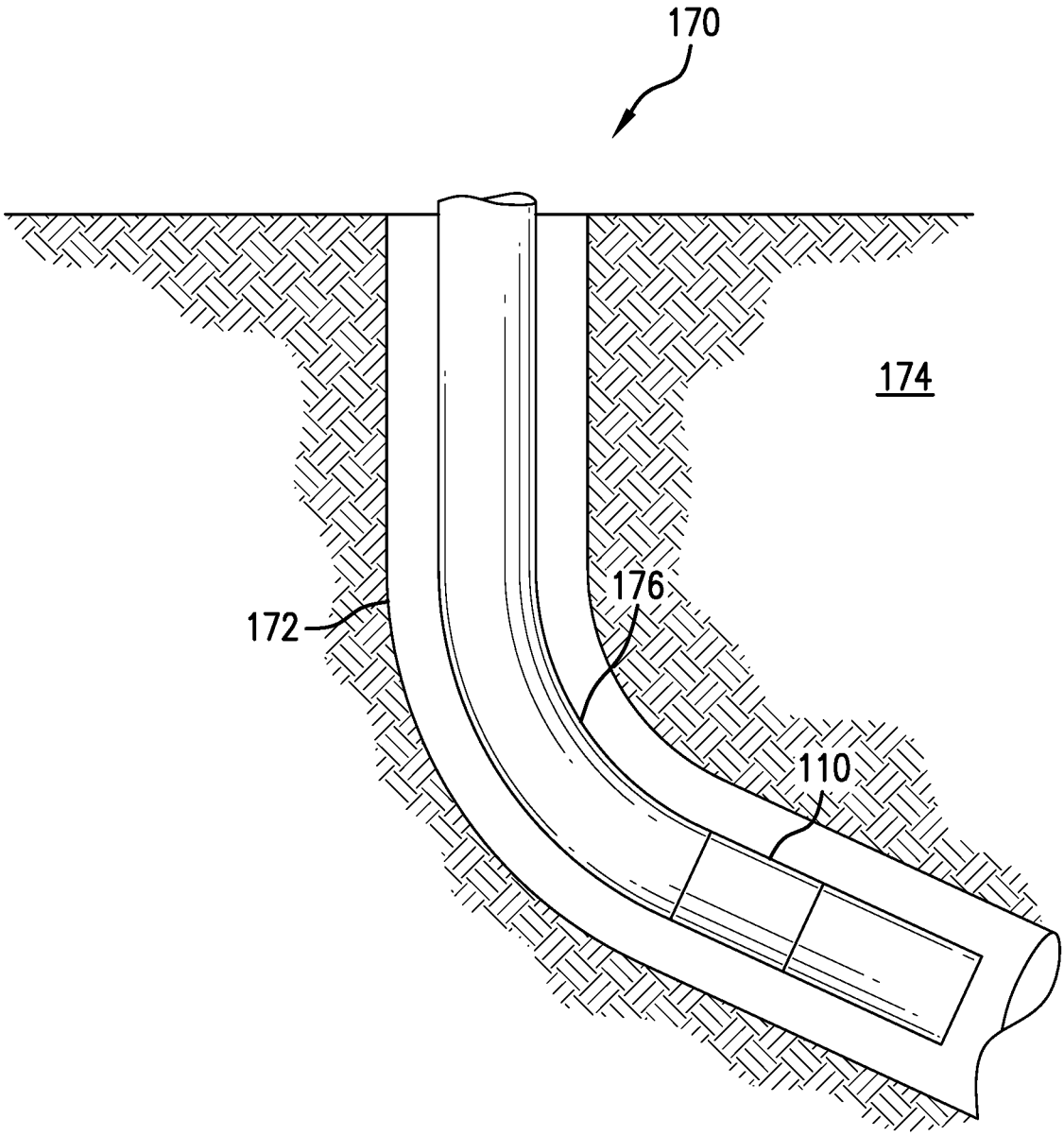
FIG. 11 is a view of a borehole system including the latch system disclosed herein.

Referring to FIG. 11, a borehole system 170 is illustrated. The system 170 comprises a borehole 172 in a subsurface formation 174. A string 176 is disposed within the borehole 172. A latch system 110 is disposed within or as a part of the string 176.

Set forth below are some embodiments of the foregoing disclosure:

Embodiment 1: A latch system including a plurality of rocker latches, a rocker support, supporting the plurality of rocker latches, and a movement restrictor in operative connection with each rocker latch of the plurality of rocker latches, the movement restrictor allowing or restricting movement of each rocker latch of the plurality of rocker latches relative to the rocker support.

Embodiment 2: The latch as in any prior embodiment wherein the plurality of rocker latches include insertion faces that collectively form part of a frustum.

Embodiment 3: The latch as in any prior embodiment wherein the insertion faces are at an angle to a longitudinal axis of the system that is different from an angle to a longitudinal axis of the system of a reception face of a separate sleeve with which the latch system engages, during use.

Embodiment 4: The latch as in any prior embodiment wherein the insertion face, the reception face or both the insertion face and reception face include a seal material.

Embodiment 5: The latch as in any prior embodiment wherein each of the plurality of rocker latches includes a rocker recess shaped to facilitate rocking movement on the rocker support.

Embodiment 6: The latch as in any prior embodiment wherein each of the plurality of rocker latches includes a catch.

Embodiment 7: The latch as in any prior embodiment wherein the rocker support is a cage.

Embodiment 8: The latch as in any prior embodiment wherein the movement restrictor is a dog.

Embodiment 9: The latch as in any prior embodiment wherein the dog includes a seal to prevent debris accumulating adjacent the dog.

Embodiment 10: The latch as in any prior embodiment further including a resilient retainer tending the plurality of rocker latches to a latched position.

Embodiment 11: A downhole tool including a sleeve movable relative to other portions of the tool, the sleeve having a profile at an uphole end thereof, an actuator runnable into contact with the sleeve, the actuator including the latch system as in any prior embodiment.

Embodiment 12: The tool as in any prior embodiment wherein the tool is a wet connect.

Embodiment 13: A borehole system including a borehole in a subsurface formation, a string in the borehole, and a latch system as in any prior embodiment disposed within or as a part of the string.

Embodiment 14: A wet connect system including a first connector housing having a first communication line therein, a second connector housing concentrically positionable in the first connector housing and having a second communication line, and a balance piston fluidly connected to the first communication line.

Embodiment 15: The system as in any prior embodiment wherein the balance piston connection to the first fluid communication line is in an annular space between the first connector housing and a sleeve therein.

Embodiment 16: The system as in any prior embodiment further comprising a running latch having a locking sleeve.

Embodiment 17: The system as in any prior embodiment further comprising a sleeve latch, the sleeve latch having a plurality of rocker latches, a rocker support, supporting the plurality of rocker latches, and a movement restrictor in operative connection with each rocker latch of the plurality of rocker latches, the movement restrictor allowing or restricting movement of each rocker latch of the plurality of rocker latches relative to the rocker support.

Embodiment 18: The system as in any prior embodiment further comprising a running latch having a locking sleeve.

Embodiment 19: The system as in any prior embodiment further comprising a rupture disk segregating a fluid of the second communication line until rupture of the disk.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A wet connect system comprising:

a first connector housing having a first communication line therein;

a second connector housing concentrically positionable in the first connector housing and having a second communication line;

a balance piston fluidly connected to the first communication line; and a latch system comprising:

a plurality of rocker latches;

a rocker support, supporting the plurality of rocker latches; and a movement restrictor in operative connection with each rocker latch of the plurality of rocker latches, the movement restrictor allowing or restricting movement of each rocker latch of the plurality of rocker latches relative to the rocker support.

2. The system as claimed in claim 1 wherein the balance piston connection to the first fluid communication line is in an annular space between the first connector housing and a sleeve therein.

3. The system as claimed in claim 1 further comprising a running latch having a locking sleeve.

4. The wet connect system as claimed in claim 1 wherein the plurality of rocker latches include insertion faces that collectively form part of a frustum.

5. The wet connect system as claimed in claim 4 wherein the insertion faces are at an angle to a longitudinal axis of the system that is different from an angle to a longitudinal axis of the system of a reception face of a separate sleeve with which the latch system engages, during use.

6. The wet connect system as claimed in claim 5 wherein the insertion face, the reception face or both the insertion face and reception face include a seal material.

7. The wet connect system as claimed in claim 1 wherein each of the plurality of rocker latches includes a rocker recess shaped to facilitate rocking movement on the rocker support.

8. The wet connect system as claimed in claim 1 wherein each of the plurality of rocker latches includes a catch.

9. The wet connect system as claimed in claim 1 wherein the rocker support is a cage.

10. The wet connect system as claimed in claim 1 wherein the movement restrictor is a dog.

11. The wet connect system as claimed in claim 10 wherein the dog includes a seal to prevent debris accumulating adjacent the dog.

12. The wet connect system as claimed in claim 1 further including a resilient retainer tending the plurality of rocker latches to a latched position.

13. The wet connect system as claimed in claim 1, further including a downhole tool comprising:

a sleeve movable relative to other portions of the tool, the sleeve having a profile at an uphole end thereof;

an actuator in contact with the sleeve.

14. A borehole system comprising:

a borehole in a subsurface formation;

a string in the borehole; and the wet connect system as claimed in claim 1 disposed within or as a part of the string.

15. A wet connect system comprising:

a first connector housing having a first communication line therein;

a second connector housing concentrically positionable in the first connector housing and having a second communication line;

a rupture disk segregating a fluid of the second communication line until rupture of the disk;

and a balance piston fluidly connected to the first communication line.

* * * * *